US008932095B1

(12) United States Patent
Hudson

(10) Patent No.: US 8,932,095 B1
(45) Date of Patent: Jan. 13, 2015

(54) STAND-UP PADDLE BOARD OUTRIGGER SYSTEM

(71) Applicant: Lee Francis Hudson, Gulf Breeze, FL (US)

(72) Inventor: Lee Francis Hudson, Gulf Breeze, FL (US)

( * ) Notice: Subject to any disclaimer, the term of this patent is extended or adjusted under 35 U.S.C. 154(b) by 174 days.

(21) Appl. No.: 13/833,986

(22) Filed: Mar. 15, 2013

(51) Int. Cl.
*B63B 43/14* (2006.01)
*B63B 35/79* (2006.01)

(52) U.S. Cl.
CPC ..... *B63B 35/7933* (2013.01); *B63B 43/14* (2013.01)
USPC ..... 441/74; 114/123

(58) Field of Classification Search
CPC ..... B63B 43/14; B63B 35/71; B63B 17/00; B63B 1/121; B63B 35/14; A01K 91/08
USPC ..... 114/61.11, 123, 343, 347, 360, 364; 24/301, 302
See application file for complete search history.

(56) References Cited

U.S. PATENT DOCUMENTS

| | | | | |
|---|---|---|---|---|
| 2002/0069808 | A1* | 6/2002 | Hesse | 114/123 |
| 2007/0277722 | A1* | 12/2007 | Martin | 114/347 |
| 2009/0025624 | A1* | 1/2009 | Boelryk | 114/364 |
| 2011/0104963 | A1* | 5/2011 | Ellis et al. | 440/6 |

* cited by examiner

*Primary Examiner* — Stephen Avila
*Assistant Examiner* — Anthony Wiest
(74) *Attorney, Agent, or Firm* — Peter Loffler

(57) ABSTRACT

An outrigger system for a paddle board uses an outrigger that is connected to the board via a pair of spaced apart extension arms that are angled upwardly above the water. A pair of plates is positioned onto opposing deck surfaces of the board and strapped together at either end and tightened so that boards of various sizes can be accommodated. The upper plate receives one end of the extension arm. Two such plate systems are provided with the lower plate spaced apart from the board surface via a riser system to help prevent plate twisting during board travel. One or two kick bars run between the two extension arms and provide a basis of side support for a rider who may be fishing and provide a rectangular frame for installing a deck between board and outrigger.

14 Claims, 4 Drawing Sheets

STAND-UP PADDLE BOARD OUTRIGGER SYSTEM

This application claims the benefit of U.S. provisional patent application number 61/663,018 filed on Jun. 22, 2012, which application is incorporated herein by reference.

BACKGROUND OF THE INVENTION

1. Field of the Invention

The present invention relates to a stand-up paddle board outrigger system that keeps the board stable during use during propulsion as well as when performing tasks other than propulsion such as fishing, hunting, SCUBA diving, or just relaxing on the water. The outrigger system holds various and diverse items thereon.

2. Background of the Prior Art

Stand-up paddle boarding has become an extremely popular sport in recent times. Unlike its cousin surfing, that relies on wave action for propulsion, stand-up paddle boarding uses the power of the rider to paddle through the water for locomotion using a paddle that is somewhat similar to a typical canoe paddle. Just like the boards used in surfing, stand-up paddle boards are elongate members designed to give substantial buoyancy to riders in the water. Stand-up paddle boards are generally larger due to their need to maintain buoyancy and stability for the rider during slow movement or even while still in the water.

Although stand-up paddle boards are very stable, especially the boards designed for leisure cruising as opposed to boards that are designed more for racing, these latter boards approaching surf board dimensions, stand-up paddle boards can tip and discharge their passenger into the water, especially if the water is not flat or near flat. This fact makes some would be paddle board riders hesitant to ride a board, especially if the would-be rider sees himself or herself as not being overly coordinated.

Additionally, many riders bring extra cargo on board the board. Typical cargo includes such items as an additional rider such as a small child or a dog, coolers full of refreshment, fishing equipment, SCUBA equipment, and hunting equipment, just to name a few. While a small cooler full of cold refreshment is usually accommodated on a stand-up paddle board relatively easily, stand-up paddle boards simply lack the storage capacity to hold large bulky items or numerous smaller items, especially the smaller boards used by smaller riders. Further, many riders like to perform additional activities while riding their board, chief among such activities is fishing.

Fishing presents certain challenges to a stand-up paddle board. One such challenge is the previously mentioned limited real estate available for storage of the items needed for fishing including the fishing equipment, and a cooler for the fish caught, possibly a second cooler for live bait and/or refreshment. Additionally, while casting the line and holding the rod while fishing presents few problems, as stand-up paddle boards are designed to be stable during non-movement of the board, when a fish is caught, especially one that is the size of more than one dinner, the rider may have difficulty remaining in a standing position on the board as there is little to brace the rider in fighting with the fish. Additional stability issues arise during the ministerial acts associated with fishing (or other activities) such as retrieving the bait, unhooking and storing the caught fish, etc., as there is little room on the board for a person to be able to move around while maintaining stability. While fishing is fun under most circumstances, many fishing people prefer to do so without taking an unexpected bath, especially if the body of water is cold.

What is needed is an outrigger system for a stand-up paddle board in order to substantially increase the stability, cargo capacity, and weight capacity of the board. Such an outrigger system must not require a permanent alteration to the stand-up paddle board and a single system must be able to accommodate stand-up paddle boards of various sizes, both in length and in beam. Such an outrigger system must be relatively inexpensive to produce. Such an outrigger system must minimize the additional drag the system introduces to the stand-up paddle board.

SUMMARY OF THE INVENTION

The stand-up paddle board outrigger system of the present invention addresses the aforementioned needs in the art by providing an outrigger system that quickly and easily attaches to a stand-up paddle board without the need to make any permanent alterations to the board. The stand-up paddle board outrigger system is essentially a one size fits all type of system so that the present invention is usable on boards of almost any size. The stand-up paddle board outrigger system is of simple design and construction and is produced using standard manufacturing techniques, making the device relatively inexpensive to obtain so as to be economically attractive to would-be purchasers of this type of device. The stand-up paddle board outrigger system is designed to reduce the drag on the overall boat generated by the extension arms of the outrigger and the outrigger itself.

The stand-up paddle board outrigger system is comprised of an outrigger and a pair of extension arms. Each extension arm has a first end that is attached to the outrigger and a second end that is removably attached to the paddle board via a strap system. The strap system comprises a top plate that is attached to the upper surface of the paddle board and a bottom plate that is attached to the lower surface of the paddle board. A first strap connects the top plate and the bottom plate and passes on the port side of the paddle board while a second strap connects the top plate and the bottom plate and passes on the starboard side of the paddle board. The top plate has at least two spaced apart first slits and the bottom plate has at least two corresponding spaced apart second slits such that the second strap passes through one of the first slits and one of the second slits. The length of the first strap is adjustable. The bottom plate is attached to the lower surface of the paddle board via a riser that extends between the bottom plate and the lower surface of the paddle board. A tubular receiver is attached to the top plate, the tubular receiver removably receiving the second end of the extension arm. The first end of the extension arm curves downwardly and outwardly and the second end of the extension arm curves downwardly and outwardly so as to raise the extension arm above the water whenever the extension arm is attached to the outrigger and the paddle board. The outrigger is curved upwardly at each end. The outrigger may be inflatable. At least one kick bar is rotatably connected to either the first end of each extension arm or to the second end of each extension bar. An angle bar is removably attachable to the kick bar and to the first end of the extension or the second end of the extension in order to maintain the kick bar is a desired angle of rotation.

BRIEF DESCRIPTION OF THE DRAWINGS

Similar reference numerals refer to similar parts throughout the several views of the drawings.

DESCRIPTION OF THE PREFERRED EMBODIMENT

Figure 1:
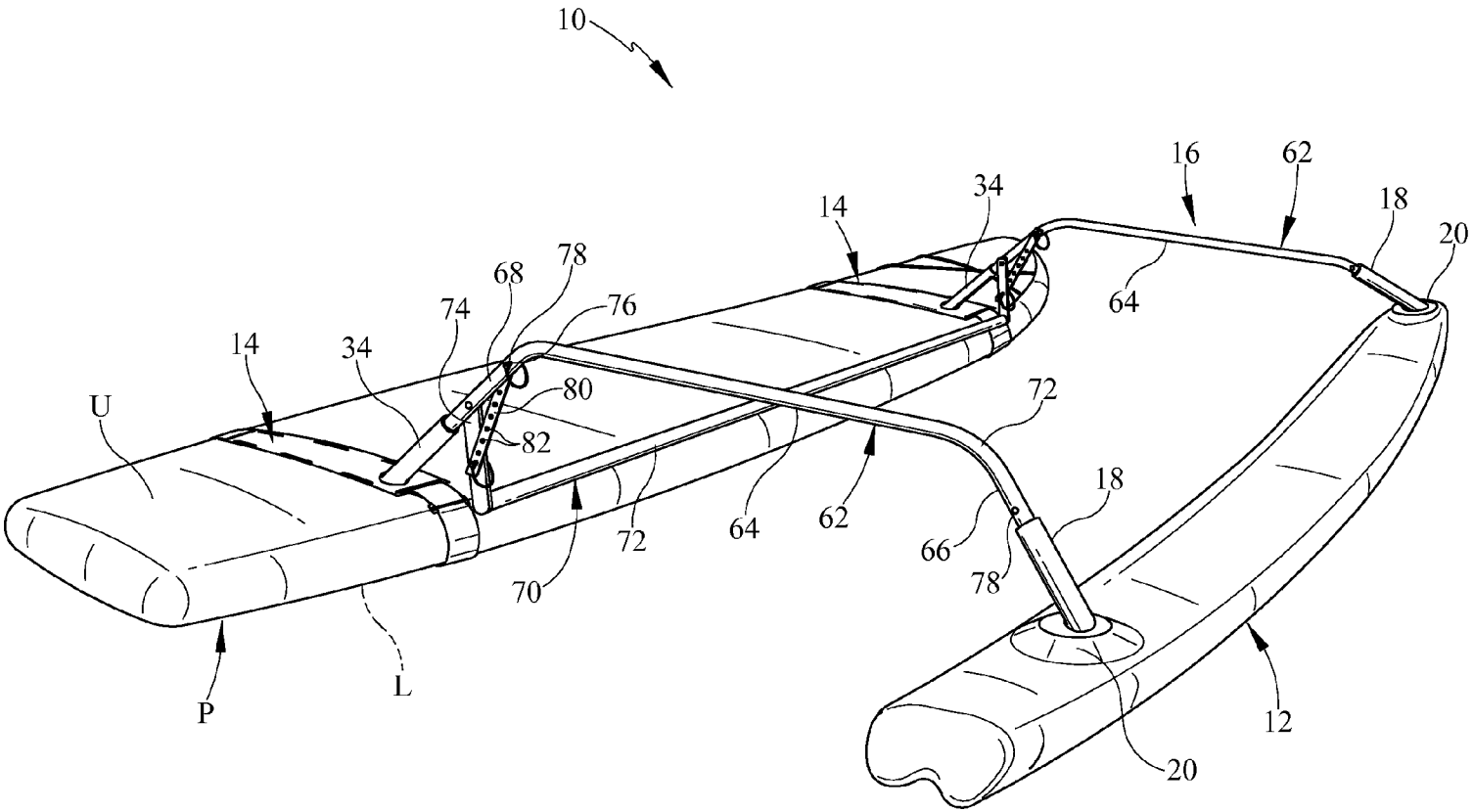
FIG. 1 is a perspective view of the stand-up paddle board outrigger system of the present invention.
Figure 2:
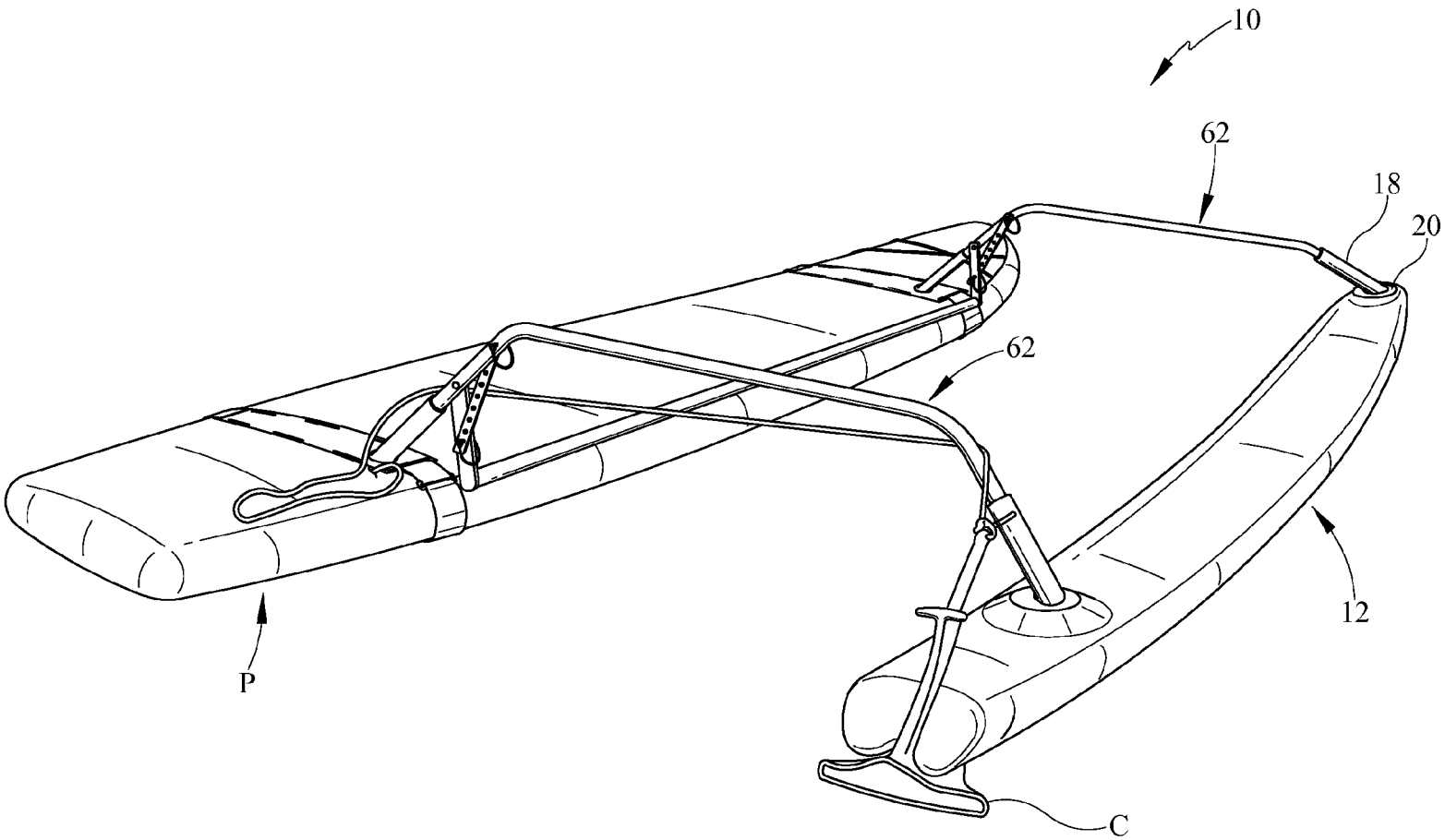
FIG. 2 is a perspective view of the stand-up paddle board outrigger system holding a typical accessory, namely an anchor.
Figure 3:
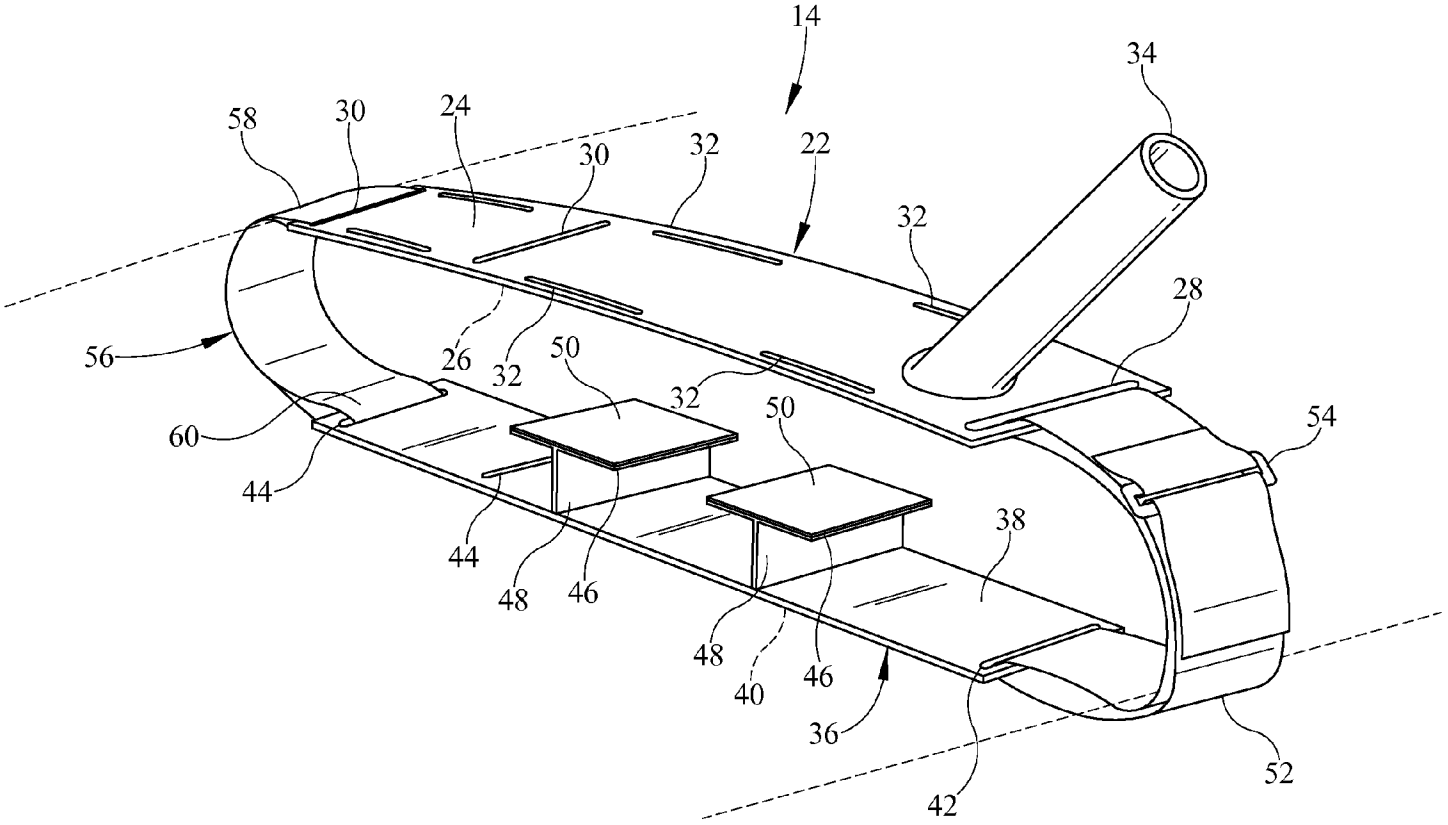
FIG. 3 is a perspective view of strap system of the stand-up paddle board outrigger system.

Referring now to the drawings, it is seen that the stand-up paddle board outrigger system of the present invention, generally denoted by reference numeral 10, is comprised of three major subsystems, an outrigger 12, a pair of strap systems 14, and a connection frame 16.

As seen, the outrigger 12 is a relatively thin elongate buoyant member that is several feet in length. The outrigger 12 is made from any appropriate buoyant material such as polyurethane, polystyrene, rotomolded plastic, etc., and may be coated in an appropriate resin as in known in the art, although the outrigger can even be inflatable. A pair of first tubular receivers 18 is secured to outrigger 12, in spaced apart fashion, in any appropriate fashion that is applicable for the material used to make the outrigger 12 so that if the outrigger 12 is made from a hard material, the first tubular member 18 may be secured to the outrigger 12 via the illustrated connection bracket 20 that is bolted to an upper surface of the outrigger. As seen, the outrigger 12 is, advantageously curved upwardly relative to its bottom surface.

As seen, each strap system 14 is comprised of a top plate 22, which is a relatively flat plate member that has a first upper surface 24 and an opposing first lower surface 26. The top plate 22 has a first longitudinal slit 28 located proximate a first end there and at least one second longitudinal slit 30, one such second longitudinal slit 30 located proximate an opposing second end of the top plate 22. A series of latitudinal slit pairs 32 are provided so that one of each pair of latitudinal slits 32 is located proximate a first side edge of the top plate 22, while the other of the pair is located opposite the first latitudinal slit 32 proximate an opposing second side edge. Extending diagonally upwardly from the top surface 24 of the top plate 22 is a hollow second tubular receiver 34, located between the first longitudinal slit 28 and the nearest second longitudinal slit 30.

A bottom plate 36 also has a second upper surface 38 and a second lower surface 40. The bottom plate 36 has a third longitudinal slit 42 located proximate a first end thereon and at least one fourth longitudinal slit 44, one such fourth longitudinal slit 44 located proximate an opposing second end of the bottom plate 36. A pair of connection plates 46 is provided and each is attached to the second upper surface 38 of the bottom plate 36 by a riser 48. Each connection plate 46 has a non-scuff layer 50 thereon.

A first strap 52 passes through the first longitudinal slit 28 of the top plate 22 and through the third longitudinal slit 42 of the bottom plate 36 and forms a closed loop via a size adjustment buckle 54. A second strap 56 has a first end 58 that loops through one of the second longitudinal slits 30 of the top plate 22 and forms a closed loop there at in order to secure this first end 58 within the selected second longitudinal slit 30, the closed loop formed via appropriate sections of cooperating hook and loop material (not illustrated) so that the first end 58 loops onto itself and is hook and loop secured in such position, or other closure means. The second strap 56 has a second end 60 that loops through a corresponding fourth longitudinal slit 44 of the bottom plate 36 and forms a closed loop there at in order to secure this second end 60 within the selected second longitudinal slit 30, the closed loop formed via appropriate sections of cooperating hook and loop material (not illustrated), or other closure means.

Each strap system 14 is attached to the paddle board P by placing the first lower surface 26 of the top plate 22 onto the upper deck surface U of a paddle board P and placing the connection plates 46 against the lower surface L of the paddle board P. The top plate 22 is oriented such that the second tubular receiver 34 faces toward the outrigger 12. If not already installed, the first strap 52 is passed through the first longitudinal slit 28 of the top plate 22 and the third longitudinal slit 42 of the bottom plate 36. The first end 58 of the second strap 56 is secured to one of the second slits 30 of the top plate 22 and the corresponding fourth slit 44 of the bottom plate 36. The selection of which second slit 30 and fourth slit 44 to use is dependent on the width of the paddle board P. The distance between the first slit 28 and the selected second slit 30 (and correspondingly, the third slit 42 and the selected fourth slit 44) must be no greater than the width of the paddle board P at the point of placement of the particular strap system 14 so that if a board P is relatively wide at the area of placement of the strap system 14, the outermost second slit 30 and fourth slit 44 are used, however, if the board P is relatively narrow, one of the inside second slits 30 and corresponding fourth slits 44 is used. Once the top plate 22 and bottom plate 36 are in the desired position, the overall length of the second trap 56 is sized at one its ends (or both) and then the size adjustment buckle 54 is used to tighten the first strap 52 so as to tighten the top plate 22 and bottom plate 36 into a tight fitting relationship with the paddle board P. The non-scuff layer 50 on each connection plate 46 helps prevent scuff damage to the lower surface L of the paddle board P. The use of the risers 48 and connection plates 46 helps prevent the bottom plate 36 from twisting during paddle board P travel, as was found when a relatively flat bottom plate was placed directly against the lower surface L of the paddle board P.

The top plate 22 and bottom plate 36, including the connection plates 46 and risers 48, can be made from any appropriate light and sturdy material that is appropriate for use in water, possibly even a salt water environment, such as plastic. The second tubular receiver 34 can be made from a similar material including PVC, as can the first tubular receiver 18.

The connection frame 16 comprises a pair of extension arms 62 that each have a central main bar 64, a first connector bar 66 that extends downwardly and outwardly from one end of the main bar 64 and a second connector bar 68 extending downwardly and outward from an opposing end of the main bar 64. The first connector bar 66 is removably received within one of the first tubular receivers 18 of the outrigger 12. The second connector bar 68 is attached to the paddle board P by being removably received within the second tubular receiver 34.

Figure 4:
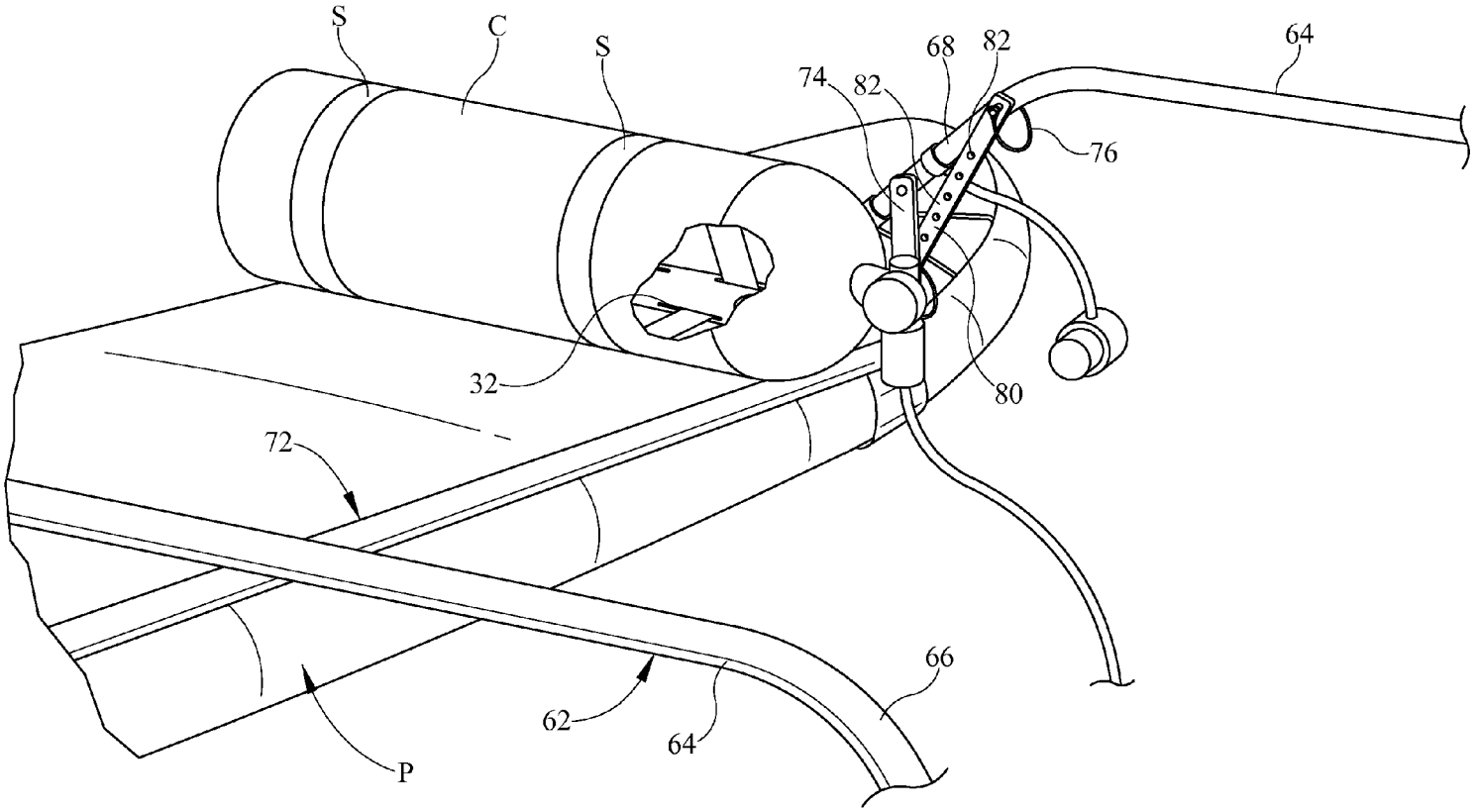
FIG. 4 is a close-up perspective view of cargo secured to the stand-up paddle board outrigger system.

In order to use the stand-up paddle board outrigger system 10 of the present invention, the first connector bar 66 of is attached to outrigger 12 by being received within the first tubular receiver 18 while the second connector bar 68 is received within a second tubular receiver 34 of the strap system 14 that is attached to the paddle board P as previously described. The other extension arm 62 of the connection frame 16 is installed in similar fashion on the opposing end of the outrigger 12 and paddle board P. The paddle board P is ready for use with the outrigger 12 attached, the rider paddling between the installed extension arms 62. Cargo C can be secured to one or both of the extension arms 62 and/or to the outrigger 12 in appropriate fashion. As the main bar 64 of the extension arm 62 is angled upwardly, the extension arms 62 provide little drag through the water, even if the water is choppy. The upwardly curved nature of the outrigger 12 helps minimize outrigger drag through the water. As seen in figure in FIG. 4, the cargo C can be lashed to the paddle board P by passing strapping through one or more of the latitudinal slit pars 32 on the top plate 22.

As seen, one or two optional kick bars 70 can be attached to the connection frame 16, on either the paddle board side, as shown, on the outrigger side, or on both sides. Each kick bar 70 comprises a long bar 72 and two pivot bars 74 one on each end of the long bar 72. Each pivot bar 74 is pivotally connected to a respective one of either the first connector bar 66 or the second connector bar 68. As such, the kick bar 70 is free to rotate about the two extension arms 62. When the kick bar 70 is rotated so that the long bar 72 is generally flush with the main bar 64 of the extension arm 62, the pivot bars 74 can each be pinned directly to their respective first connection bar 66 or second connection bar 68, depending on whether the kick bar 70 is located outrigger side or paddle board side respectively, by passing a pin 76 through an opening (not separately numbered) on the pivot bar 74 and an aligned pair of corresponding openings 78 located on the first connection bar 66 or second connection bar 68. In order to hold the kick bar 70 in a different desired position, a pair of angle bars 80 is provided and each angle bar 80 is pivotally connected to the first connector bar 66 or second connector bar 68, as appropriate via the pin 76 passing through the openings 78 and an aligned opening on the angle bar 80. The angle bar 80 is also pinned to the pivot bar 74 by passing another pin 76 through the opening on the pivot bar 74 and one of the series of openings 82 located along the length of the angle bar 80, the particular opening 82 used depending on the position of the kick bar 70.

The kick bar 70, when installed on the paddle board P side, can be used as a brace when fishing or hunting or conducting other activates and can also be used to help secure cargo C. If kick bars 70 are located on both the paddle board side and the outrigger side, then each kick bar 70 can be positioned so that its long bar 72 is generally flush with the main bar 64 of each extension arm 62 and a canvas (not illustrated) can be spread over and secured to the extension arms 62 and kick bars 70 in order to provide a deck between the paddle board P and the outrigger 12.

While the invention has been particularly shown and described with reference to an embodiment thereof, it will be appreciated by those skilled in the art that various changes in form and detail may be made without departing from the spirit and scope of the invention.

I claim:

1. An outrigger system for use with a paddle board having an upper surface, a lower surface, a bow, a stern, a port side, and a starboard side, the outrigger system comprising:

an outrigger;

a pair of extension arms, each extension arm having a first end attached to the outrigger and a second end removably attached to the paddle board via a strap system;

the strap system comprising a top plate attached to the upper surface of the paddle board;

a bottom plate attached to the lower surface of the paddle board;

a first strap connecting the top plate and the bottom plate and passing on the port side of the paddle board;

a second strap connecting the top plate and the bottom plate and passing on the starboard side of the paddle board; and wherein the bottom plate is attached to the lower surface of the paddle board via a riser that extends between the bottom plate and the lower surface of the paddle board.

2. The outrigger system as in claim 1 wherein the top plate has at least two spaced apart first slits and the bottom plate has at least two corresponding spaced apart second slits such that the second strap passes through one of the first slits and one of the second slits.

3. The outrigger system as in claim 2 wherein a length of the first strap is adjustable.

4. The outrigger system as in claim 1 further comprising a tubular receiver attached to the top plate, the tubular receiver removably receiving the second end of the extension arm.

5. The outrigger system as in claim 4 wherein the first end of the extension arm curves downwardly and outwardly and the second end of the extension arm curves downwardly and outwardly.

6. The outrigger system as in claim 5 wherein the outrigger is curved upwardly at each end.

7. The outrigger system as in claim 5 wherein the outrigger is inflatable.

8. The outrigger system as in claim 7 further comprising a kick bar rotatably connected to either the first end of each extension arm or to the second end of each extension bar.

9. The outrigger system as in claim 8 further comprising an angle bar removably attachable to the kick bar and to the first end of the extension or the second end of the extension in order to maintain the kick bar is a desired angle of rotation.

10. The outrigger system as in claim 1 wherein the first end of the extension arm curves downwardly and outwardly and the second end of the extension arm curves downwardly and outwardly.

11. The outrigger system as in claim 1 wherein the outrigger is curved upwardly at each end.

12. The outrigger system as in claim 1 wherein the outrigger is inflatable.

13. The outrigger system as in claim 1 further comprising a kick bar rotatably connected to either the first end of each extension arm or to the second end of each extension bar.

14. The outrigger system as in claim 13 further comprising an angle bar removably attachable to the kick bar and to the first end of the extension or the second end of the extension in order to maintain the kick bar is a desired angle of rotation.

* * * * *